US007530180B2

(12) United States Patent
Chiang et al.

(10) Patent No.: US 7,530,180 B2
(45) Date of Patent: May 12, 2009

(54) MOBILE COMMUNICATION HANDSET WITH ADAPTIVE ANTENNA ARRAY

(75) Inventors: Bing Chiang, Melbourne, FL (US); Christopher A. Snyder, Melbourne, FL (US); Griffin K. Gothard, Satellite Beach, FL (US); David C. Jorgenson, Melbourne, FL (US)

(73) Assignee: IPR Licensing, Inc., Wilmington, DE (US)

( * ) Notice: Subject to any disclaimer, the term of this patent is extended or adjusted under 35 U.S.C. 154(b) by 0 days.

(21) Appl. No.: 11/706,538

(22) Filed: Feb. 15, 2007
(Under 37 CFR 1.47)

(65) Prior Publication Data

US 2007/0152892 A1 Jul. 5, 2007

Related U.S. Application Data

(63) Continuation of application No. 11/079,811, filed on Mar. 14, 2005, now Pat. No. 7,190,313, which is a continuation of application No. 10/390,531, filed on Mar. 14, 2003, now Pat. No. 6,876,331.

(60) Provisional application No. 60/365,140, filed on Mar. 14, 2002.

(51) Int. Cl.
*H01Q 1/24* (2006.01)

(52) U.S. Cl. ..... 34/702

(58) Field of Classification Search ..... 343/702, 343/700 MS, 795, 797
See application file for complete search history.

(56) References Cited

U.S. PATENT DOCUMENTS

| | | | |
|---|---|---|---|
| 3,846,799 | A | 11/1974 | Gueguen |
| 3,972,044 | A | 7/1976 | Alford |
| 5,231,413 | A | 7/1993 | Dubois |
| 5,313,660 | A | 5/1994 | Lindenmeier et al. |
| 5,617,102 | A | 4/1997 | Prater |
| 5,629,713 | A | 5/1997 | Mailandt et al. |
| 5,905,473 | A | 5/1999 | Taenzer |
| 5,936,583 | A | 8/1999 | Sekine et al. |
| 5,940,044 | A | 8/1999 | Smith |
| 6,040,803 | A | 3/2000 | Spall |
| 6,049,310 | A | 4/2000 | Sadahiro |
| 6,167,039 | A | 12/2000 | Karlsson et al. |

(Continued)

FOREIGN PATENT DOCUMENTS

| | | |
|---|---|---|
| EP | 0860897 | 8/1998 |

(Continued)

OTHER PUBLICATIONS

Vaughn R., "Switched Parasitic Elements for Antenna Diversity", IEEE Transactions on Antennas and Propagation, vol. 47, No. 2, Feb. 1999, pp. 399-405.

(Continued)

*Primary Examiner*—Huedung Mancuso
(74) *Attorney, Agent, or Firm*—Volpe And Koenig, P.C.

(57) ABSTRACT

A wireless mobile handset includes an antenna array. The antenna array includes a passive element disposed on a first portion of a dielectric substrate and an active element disposed on a second portion of the dielectric substrate. The passive element is configured to operate in a reflective mode to produce a bi-directional radiation pattern.

6 Claims, 12 Drawing Sheets

U.S. PATENT DOCUMENTS

| | | | | |
|---|---|---|---|---|
| 6,184,836 | B1 | 2/2001 | Ali | |
| 6,198,442 | B1 | 3/2001 | Rutkowski et al. | |
| 6,204,826 | B1 | 3/2001 | Rutkowski et al. | |
| 6,225,951 | B1 | 5/2001 | Holshouser et al. | |
| 6,268,831 | B1 | 7/2001 | Sanford | |
| 6,392,610 | B1 | 5/2002 | Braun et al. | |
| 6,456,249 | B1 | 9/2002 | Johnson et al. | |
| 6,480,157 | B1 * | 11/2002 | Palmer et al. | 343/700 MS |
| 6,483,470 | B1 | 11/2002 | Hohnstein et al. | |
| 6,496,152 | B2 | 12/2002 | Nilsson | |
| 6,498,804 | B1 | 12/2002 | Ide et al. | |
| 6,501,943 | B1 | 12/2002 | Ide et al. | |
| 6,606,057 | B2 * | 8/2003 | Chiang et al. | 342/374 |
| 7,034,761 | B2 * | 4/2006 | Chiang et al. | 343/745 |
| 7,038,626 | B2 | 5/2006 | Gothard et al. | |
| 7,046,202 | B2 | 5/2006 | Chiang et al. | |
| 7,126,553 | B1 * | 10/2006 | Fink et al. | 343/767 |
| 2001/0029173 | A1 | 10/2001 | Ogino | |
| 2002/0008672 | A1 | 1/2002 | Gothard et al. | |
| 2002/0113743 | A1 | 8/2002 | Judd et al. | |

FOREIGN PATENT DOCUMENTS

| | | |
|---|---|---|
| WO | 94/285595 | 12/1994 |

OTHER PUBLICATIONS

Ohira and Gyoda, "Electronically Steerable Passive Array Radiator Antennas for low-Cost Analog Adaptive Beamforming," 0-7803-6345-0/00, 2000 IEEE.

Preston, S., et al., "Base-Station Tracking in Mobile Communications Using a Switched Parasitic Antenna Array", IEEE Transactions on Antennas and Propagation, vol. 46, No. 6, Jun. 1998, pp. 841-844.

Scott, et al., "Diversity Gain from a Single-Port Adaptive Antena Using Switched Parasitic Elements Illustrated with a Wire and Monopole Prototype," IEEE Transactions on Antennas and Propagation, vol. 47, No. 6, Jun. 1999.

King, Ronold W.P., The theory of Linear Antennas, pp. 635-637, Harvard University Press, Cambridge, Mass., 1956.

* cited by examiner

MOBILE COMMUNICATION HANDSET WITH ADAPTIVE ANTENNA ARRAY

CROSS REFERENCE TO RELATED APPLICATION(S)

This application is a continuation of U.S. application Ser. No. 11/079,811 filed on Mar. 14, 2005 which is a continuation of U.S. application Ser. No. 10/390,531, filed Mar. 14, 2003, which claims the benefit of U.S. Provisional Application No. 60/365,140, filed on Mar. 14, 2002. The entire teachings of the above application(s) are incorporated herein by reference.

BACKGROUND

Code Division Multiple Access (CDMA) modulation and other spread spectrum techniques now find widespread application in wireless systems such as cellular mobile telephones, wireless local area networks and similar systems. In these systems a connection is provided between a central hub or base station and one or more mobile or remote subscriber units. The base station typically includes a specialized antenna for sending forward link radio signals to the mobile subscriber units and for receiving reverse link radio signals transmitted from the mobile units. Each mobile subscriber unit also contains its own antenna for the reception of the forward link signals and for transmission of reverse link signals. A typical mobile subscriber unit may for example, be a digital cellular telephone handset or a personal digital assistant having an incorporated cellular modem, or other wireless data device. In CDMA systems, multiple mobile subscriber units are typically transmitting and receiving signals on the same carrier frequency at the same time. Unique modulation codes distinguish the signals originating from or intended to be sent to individual subscriber units.

Other wireless access techniques also use spread spectrum for communications between a centralized unit and one or more remote or mobile units. These include the local area network standard promulgated by the Institute of the Electrical and Electronic Engineers (IEEE) 802.11 and the industry developed wireless Bluetooth standard.

The most common antenna used in a mobile subscriber unit is a monopole. A monopole antenna most often consists of a single wire or other elongated metallic element. A signal transmitted from such a monopole antenna is generally omnidirectional in nature. That is, the signal is sent with approximately the same signal power in all directions in a generally horizontal plane. Reception of a signal with a monopole antenna, element, is likewise omnidirectional. A monopole antenna therefore cannot differentiate between signals originating from one direction versus a different signal originating from another direction. Although most monopole antennas do not produce significant radiation in the elevation plane, the expected antenna pattern in three dimensions is typically a donut-like toroidal shape, with the antenna element located at the center of the donut hole.

Unfortunately, CDMA communication systems are typically interference limited. That is, as more and more subscriber units become active within a particular area and share access to the same base station, interference increases among them, and thus so does the bit error rate they experience. To maintain system integrity in the face of increasing error rates, often the maximum data rate available to one or more users must be decreased, or the number of active units must be limited in order to clear the radio spectrum.

It is possible to eliminate excessive interference by using directive antenna at either the base station and/or the mobile units. Typically, a directive antenna beam pattern is achieved through the use of a phased array antenna at the base station.

The phased array is electronically scanned or steered in a desired direction by controlling the phase angle of a signal input to each antenna element.

However, phased array antennas suffer decreased efficiency and gain as arrays become electrically small as compared to the wavelength of the radiated signals. When phased arrays are used or attempted to be used in conjunction with a hand-held portable subscriber unit, the antenna arrays spacing must be relatively small and therefore antenna performance is correspondingly compromised.

SUMMARY

Several considerations should be taken into account when designing an antenna for a hand-held wireless device. For example, careful consideration should be given to the electrical characteristics of the antenna so that propagating signals satisfy predetermined standards requirements such as, for example, bit error rate, signal to noise ratio or signal to noise plus interference ratio.

The antenna should also exhibit certain mechanical characteristics to satisfy the needs of a typical user. For example, the physical length of each element of the antenna array depends upon the transmit and receive signal frequency. If the antenna is configured as monopole, the length is typically a quarter wavelength of a signal frequency; for operation at 800 MegaHertz (MHz) (one of the more popular wireless frequency bands) a quarter wavelength monopole must typically be about 3.7" long.

The antenna should furthermore present an esthetically pleasing appearance. Especially when used in a mobile or handheld portable unit, the whole device must remain relatively small and light with a shape that allows it to be easily carried. The antenna therefore must be mechanically simple and reliable.

Not only are the electrical, mechanical and aesthetic properties of the antenna important, but it must also overcome unique performance problems in the wireless environment. One such problem is called multipath fading. In multipath fading, a radio signal transmitted from a sender (either a base station or mobile subscriber unit) may encounter interference in route to the intended receiver. The signal may, for example, be reflected from objects, such as buildings, thereby directing a reflected version of the original signal to the receiver. In such instances, two versions of the same radio signal are received; the original version and a reflected version. Each received signals is at the same frequency, but the reflected signal may be out of phase with the original due to the reflection and consequence differential transmission path length to the receiver. As a result, the original and reflected signals may partially cancel each other out (destructive interference), resulting in fading or dropouts in the received signal.

Single element antennas are highly susceptible to multipath fading. A single element antenna cannot determine the direction from which a transmitted single element is sent and therefore cannot be turned to more accurately detect and received a transmitted signal. Its directional pattern is fixed by the physical structure of the antenna components. Only the antenna position and orientation can be changed in an effort to obviate the multipath fading effects.

The dual element antenna described in the aforementioned patent reference is also susceptible to multipath fading due to the symmetrical and opposing nature of the hemispherical lobes of the antenna pattern. Since the antenna pattern's lobes, evident in the elevation cut, are more or less symmetrical and opposite from one another, a signal reflected to the back side of the antenna may have the same received power as a signal received at the front. That is, if the transmitted signal reflects from an object beyond or behind the intended received and then reflects into the back side of the antenna, it will interfere with the signal received directly from the source, at points in space where the phase difference in the two signals creates destructive interference due to multipath fading.

Another problem present in cellular communication systems is inter-cell signal interference. Most cellular systems are divided into individual cells, with each cell having a base station located at its center. The placement of each base station is arranged such that neighboring base stations are located at approximately sixty degree intervals from each other. Each cell may be viewed as a six sided polygon with a base station at the center. The edges of each cell abut the neighboring cells and a group of cells form a honeycomb-like pattern. The distance from the edge of a cell to its base station is typically driven by the minimum power required to transmit an acceptable signal from a mobile subscriber unit located near the edge of the cell to that cell's bases station (i.e., the power required to transmit an acceptable signal a distance equal to the radius of one cell).

Intercell interference occurs when a mobile subscriber unit near the edge of one cell transmits a signal that crosses over the edge into a neighboring cell and interferes with communications taking place within the neighboring cell. Typically, signals in neighboring cells on the same or closely spaced frequencies cause intercell interference. The problem of intercell interference is compounded by the fact that subscriber units near the edges of a cell typically transmit at higher power levels so that the transmitted signals can be effectively received by the intended base station located at the cell center. Also, the signal from another mobile subscriber unit located beyond or behind the intended receiver may arrive at the base station at the same power level, representing additional interference.

The intercell interference problem is exacerbated in CDMA systems since the subscriber units in adjacent cells typically transmit on the same carrier or center frequency. For example, two subscriber units in adjacent cells operating at the same carrier frequency but transmitting to different base stations interfere with each other if both signals are received at one of the base stations. One signal appears as noise relative to the other. The degree of interference and the receiver's ability to detect and demodulate the intended signal is also influenced by the power level at which the subscribed units are operating. If one of the subscriber units is situated at the edge of a cell, it transmits at a higher power level, relative to other units within its cell and the adjacent cell, to reach the intended base stations. But, its signal is also received by the unintended base station, i.e., the base station in the adjacent cell. Depending on the relative power level of two same-carrier frequency signals received at the unintended base station, it may not be able to properly differentiate a signal transmitted from within its cell from the signal transmitted from the adjacent cell. A mechanism is required to reduce the subscriber units antenna's apparent field of view, which can have a marked effect on the operation of the reverse link (subscriber to base) by reducing the number of interfering transmissions received at a base station. A similar improvement in the antenna pattern for the forward link, allows a reduction in the transmitted signal power to achieve a desired receive signal quality.

In summary, it is clear that in the wireless communications technology, it is of utmost importance to maximize antenna performance, while minimizing size and manufacturing complexity.

The present invention is a mobile communication handset including at least one passive antenna element and an active antenna element adjacent to the passive antenna elements protruding from a housing. Preferably, there are one or two passive elements, resulting in two-element and three-element adaptive antenna arrays, respectively. The active element is coupled to electronic radio communication circuits and the passive antenna elements are coupled to circuit elements that affect the directivity of communication signals coupled to the antenna elements. Although not so limited, the antenna elements may be monopole or dipole elements. According to various embodiments, the antenna elements may be (i) rigid conductive strips, (ii) conductive strips adhered to a flexible film, or (iii) conductive segments disposed on portions of a dielectric substrate.

Where the antenna elements are disposed on a dielectric substrate, the passive and active antenna elements may be located on the same face of the dielectric substrate providing a linear antenna array configuration. Alternatively, at least one of the passive antenna elements may be located on an opposite face of the dielectric substrate in order to facilitate a greater range of directive beam patterns provided by a non-linear array configuration.

The handset may also include a ground structure and one or more switches. The switch can be disposed between the passive element and the ground structure controlling electromagnetic coupling therebetween. When the switch couples the passive element to ground, the passive element operates in a reflective mode. When the passive element is coupled to an open circuit, the passive element operates in a directive mode. The switch may also have multiple positions controllably connecting to other impedance elements. In this way, the switch controls the active and passive elements to operate selectively as either an omnidirectional antenna array in one state, or a directional antenna array having directive beams of different shapes and pointing at different directions in other states.

In particular embodiments, the ground structure may have a shape that localizes current or near fields of the antenna elements toward the base of the antenna elements. In this way, negative performance effects imposed by a human hand holding the handset or the body of the handset itself can be reduced.

Where the antenna array includes two antenna elements, a first antenna element is active coupling to electronic radio communication circuits and a second antenna element is passive coupling to circuit elements that affect the directivity of communication signals coupled to the antenna elements. According to another embodiment, individual switches coupled to the antenna elements may be synchronized in order to swap active and passive states between the elements.

BRIEF DESCRIPTION OF THE DRAWING(S)

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIGS. 1A, 1B, and 1C are high level schematic diagrams of wireless communication devices incorporating a three-element adaptive directional antenna array according to various embodiments.

FIGS. 7A through 7D have high level schematic diagrams of alternate ground structures for a three-element adaptive array according to various embodiments.

Figure 8:
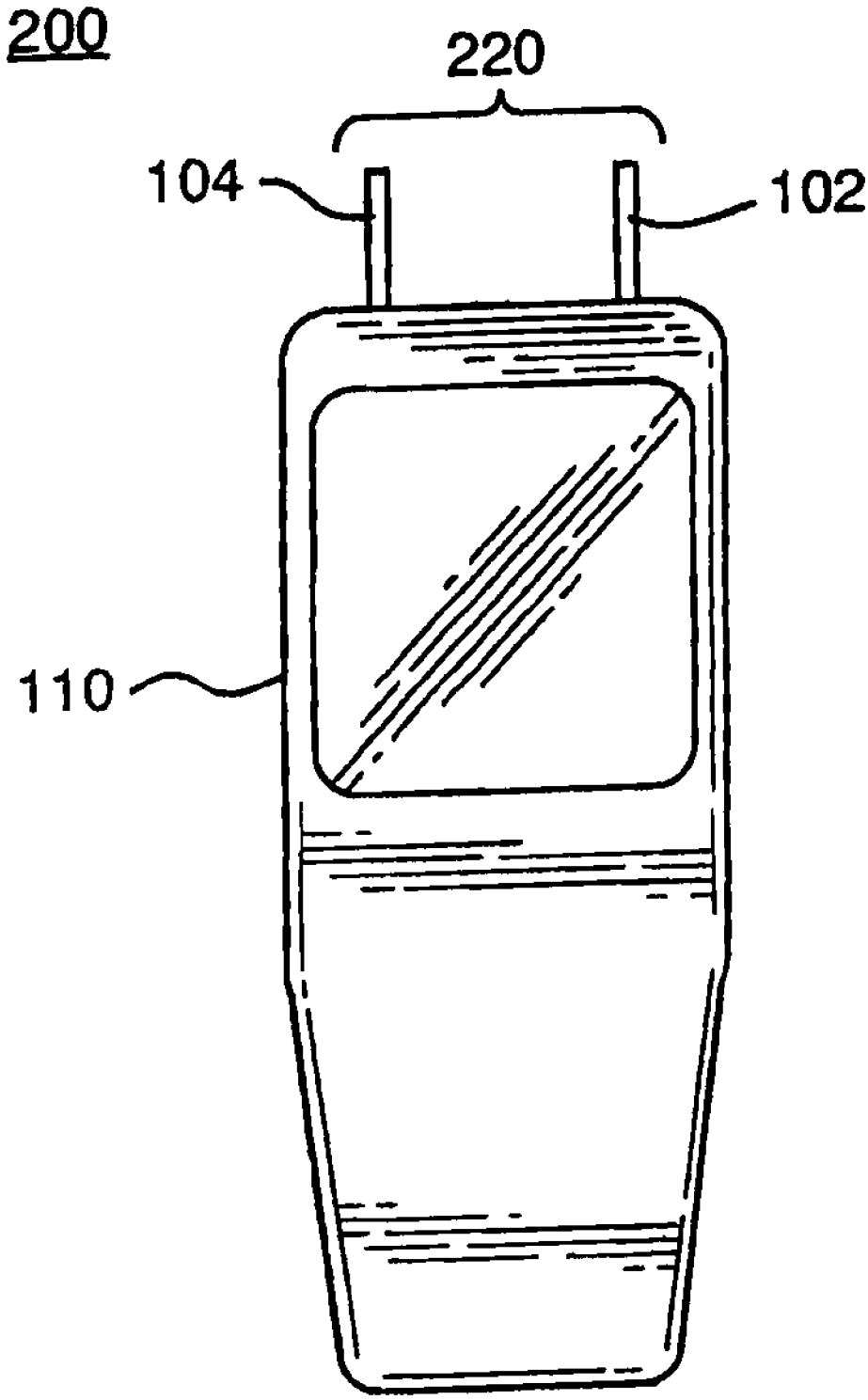

FIG. 8 is a schematic diagram of a wireless communication device incorporating a two-element adaptive antenna array according to one embodiment.

Figure 9:
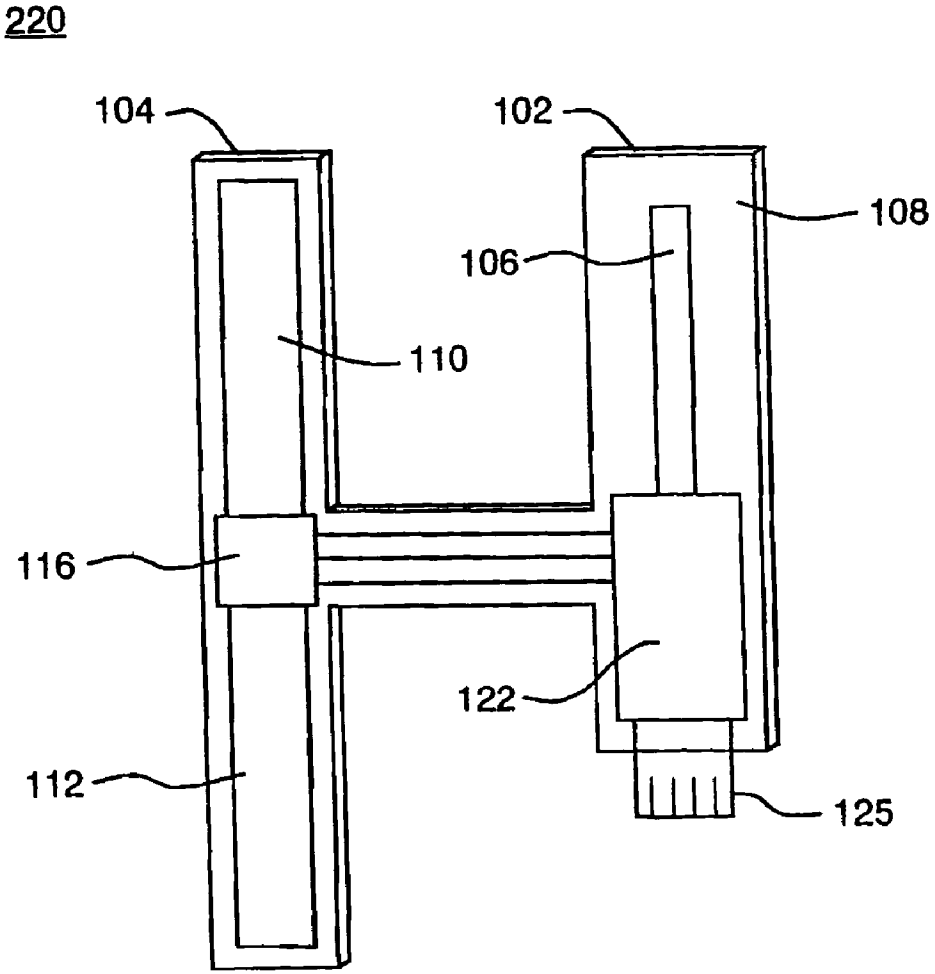

FIG. 9 is a more detailed plan of a two-element adaptive antenna array according to one embodiment.

Figure 10A:
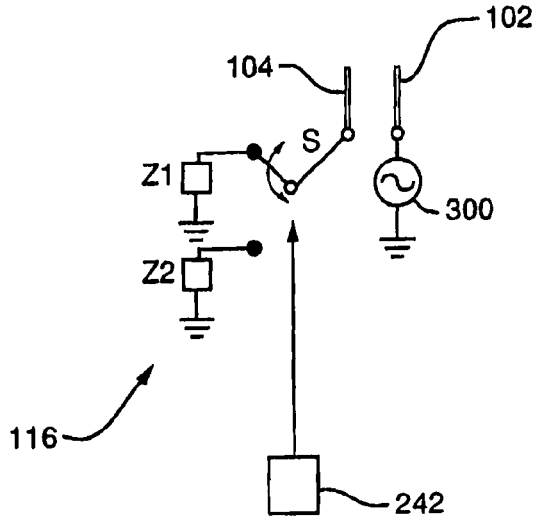
Figure 10B:
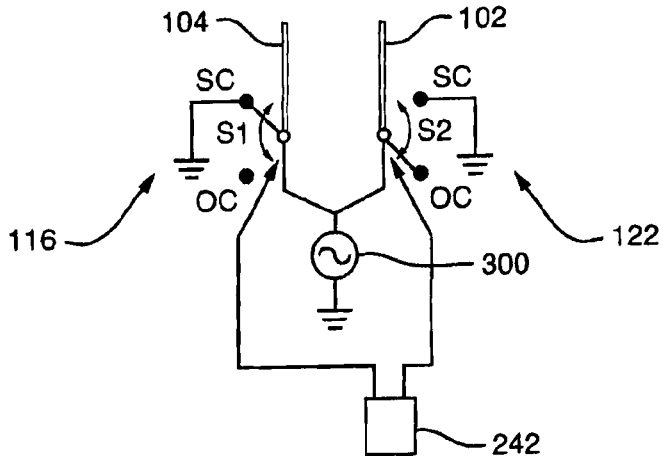
Figure 10C:
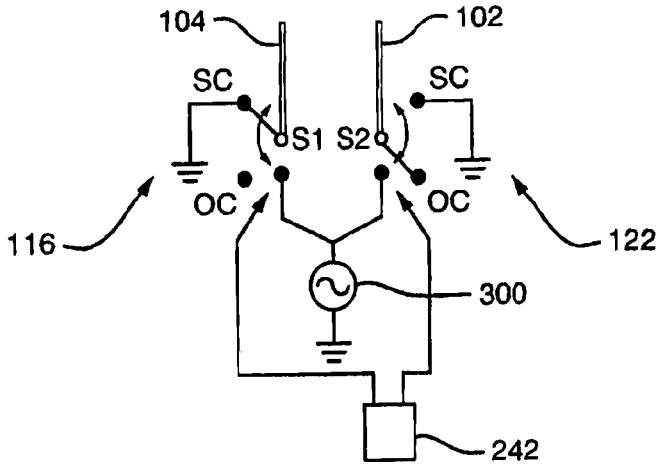

FIGS. 10A through 10C illustrate alternate circuit diagrams showing feed structures for a two-element adaptive antenna array according to various embodiments.

DETAILED DESCRIPTION OF THE PREFERRED EMBODIMENT

Figure 1A:
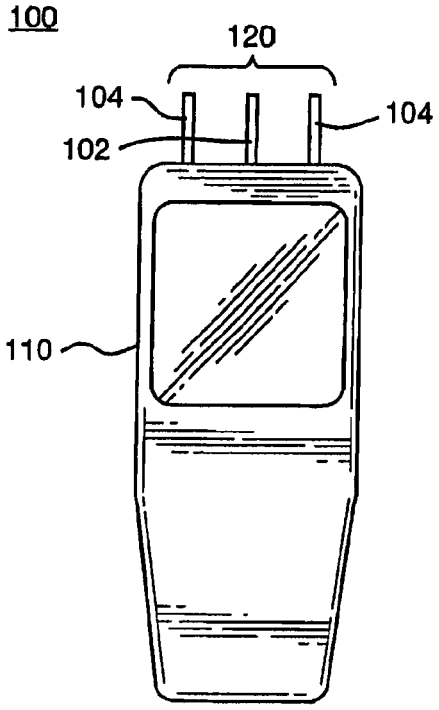
Figure 1B:
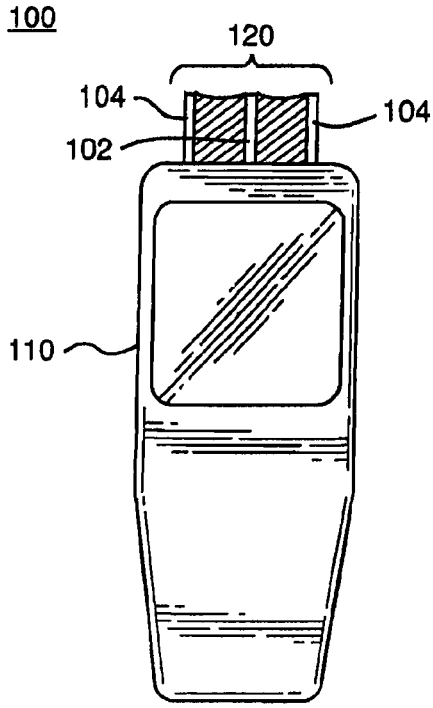
Figure 1C:
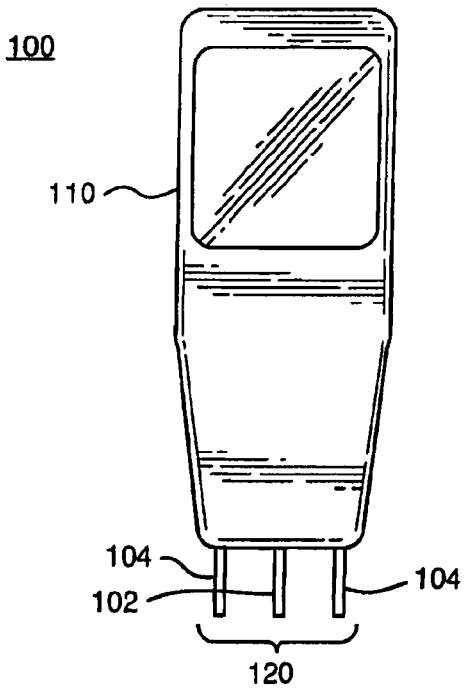

FIGS. 1A, 1B, 1C are high level schematic diagrams of wireless communication devices incorporating a three-element adaptive directional antenna array according to various embodiments. In general, the devices 100 are some form of wireless communications device, such as a mobile communication handset (e.g., cellular handset) or a personal digital assistant (e.g., Palm Pilot). Each device 100 includes a housing 110 having incorporated therein an antenna array 120.

The antenna array 120 provides for directional reception and transmission of radio communication signals with a base station, in the case of a cellular handset 100, or from an access point, in the case of a wireless data unit 100 making use of wireless local area network (WLAN) protocols. By directively communicating signals with a particular base station and/or access point, the antenna array 120 assists in reducing the overall effect of intercell interference and multipath fading for the mobile unit 100. Moreover, as will be understood shortly, since antenna beam patterns generated by the antenna array extend outward in a desired direction, but are attenuated in most other directions, less power is required for effective transmission by the base station.

In an example embodiment, the antenna array 120 includes an active center element 102 and a pair of passive elements 104, one on each side thereof. As will be understood shortly, the passive elements 104 can each be operated in either a reflective or directive mode; it is through this expediency that the array 120 can be steered to a particular direction. Although these embodiments show three elements, it should be understood that the array 120 is not so limited, and that one, two, three, or four, or even more passive elements may be included. Yet other embodiments are possible for the antenna array such as phased array, where the center element 102 is absent and the other elements are themselves used as active elements, together with active signal combining circuitry.

Although not so limited, the antenna elements may be monopole elements or dipole elements. Dipole elements will enhance gain, but will require an increase in height. However, the height will be less of an issue in the future as the need for access to clear spectrum drives system operators to use high carrier frequencies.

Referring to FIGS. 1A and 1B, the antenna array may be mounted on top of the handset with part of the antenna ground structure (not shown) hidden inside. Alternatively, as in FIG. 1C, the antenna array may be mounted at the bottom of the handset away from obstruction and absorption, such as the human brain.

The antenna elements protruding from the housing may be conductive segments having a dielectric substrate backing and optionally covered with a protective coating. The protruding portions of the antenna elements may also be relatively rigid conductors, optionally covered with a protective coating or metal. Alternatively, as in FIG. 1B, the antennas can be thin conductor strips adhered to a film of different degrees of flexibility.

These antenna elements are suitable for resonating at PCS bands. However, the active element 102 may be implemented with a pull-out whip antenna for communicating at 800 MHz. Relative to the extended length of the active element, the passive (parasitic) elements are short and thus are transparent at 800 MHz. This antenna array configuration results in a single monopole radiating at 800 MHz.

Figure 2:
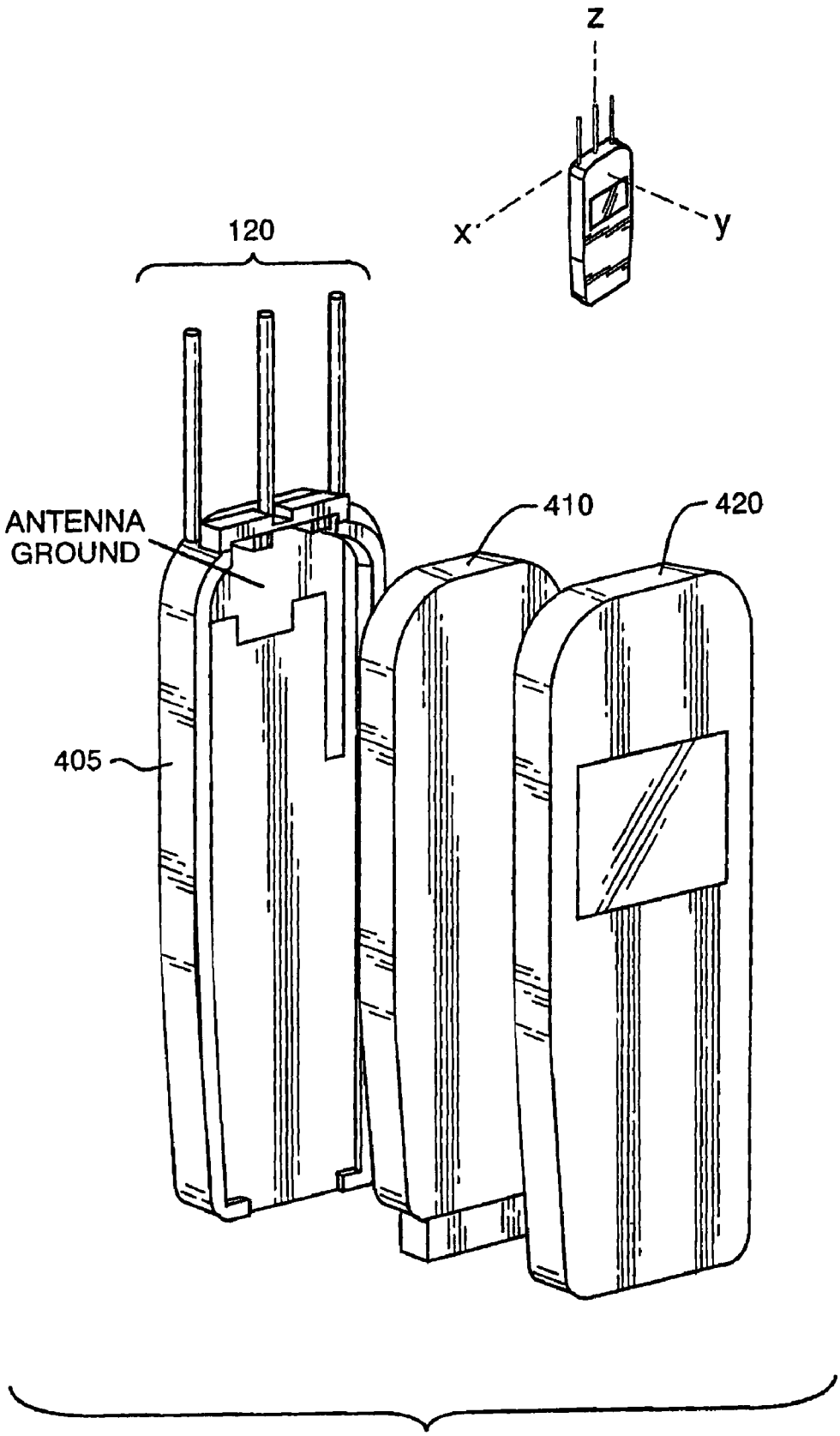
FIG. 2 is an exploded view illustrating the integration of a three-element adaptive directional antenna array into a handset according to one embodiment.

FIG. 2 is an exploded view illustrating the integration of a three-element adaptive directional antenna array into a handset according to one embodiment. In this embodiment, the three-element directional array 120 is formed on a printed circuit board and placed within a rear cover 405 of a handset, for example. A center module 410 may include electronic circuitry, radio reception and transmission equipment, and the like. A final module 420 may serve as, for example, a front cover of the device. What is important to see here is that the printed circuit board implementation of the antenna array 120 can be easily fit within a handset form factor. In an alternate embodiment, the antenna array 120 may be formed as an integral part of the center module 410, resulting in the array 120 and the center module 410 being fabricated on the same printed circuit board.

Figure 3A:
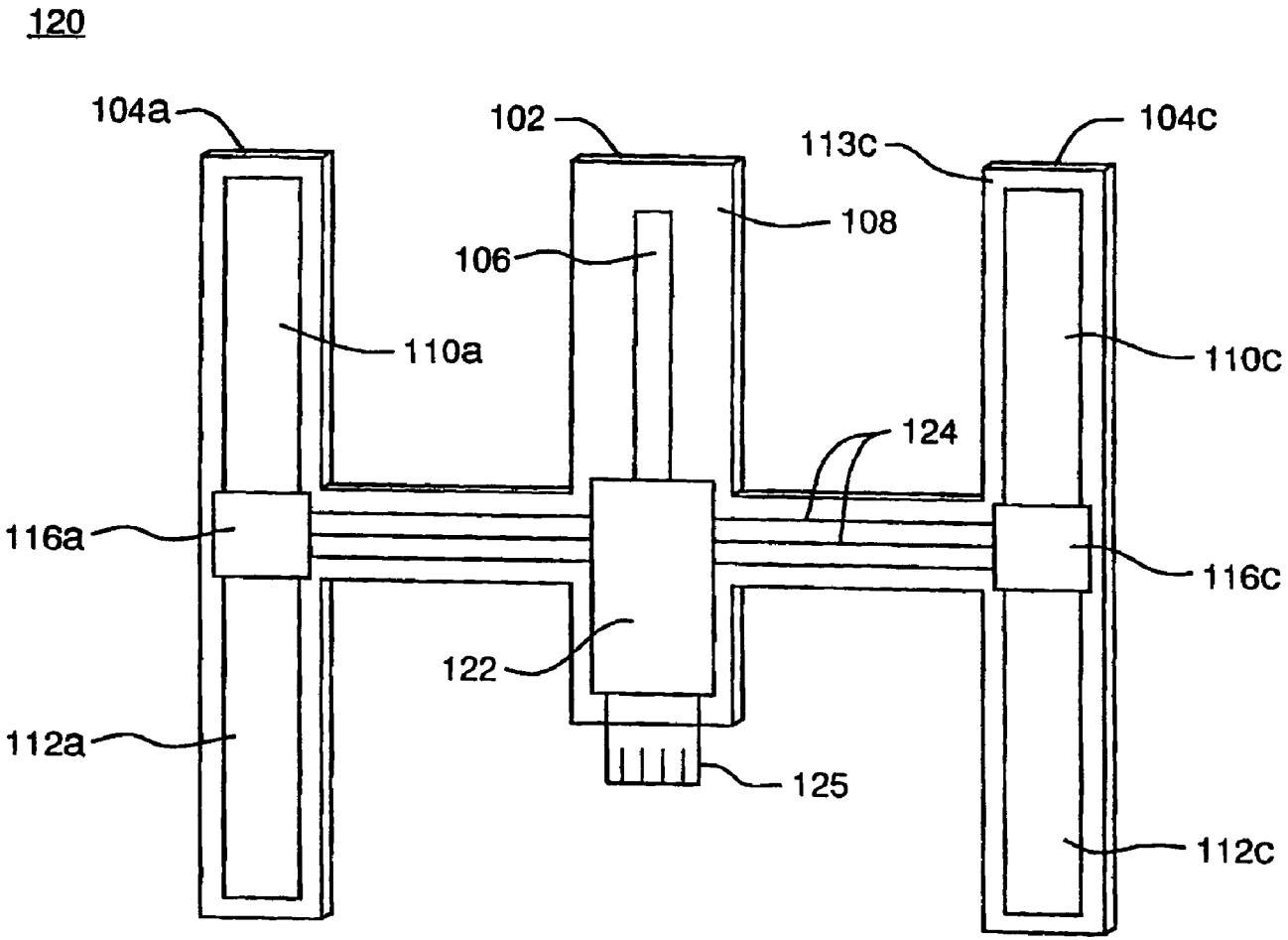
FIG. 3A is a more detailed plan of a three-element adaptive antenna array according to one embodiment.

FIG. 3A is more detailed view of a three element adaptive antenna array according to one embodiment. Here the antenna array 120 is disposed on portions of a dielectric substrate such as a printed circuit board, including the center element 102 and passive elements 104*a* and 104*c* previously described. Each of the passive elements 104 can be operated in a reflective or directive mode as will be understood shortly.

The center element 102 comprises a conductive radiator 106 disposed on the dielectric substrate 108. The passive elements 104*a* and 104*c* themselves each have an upper conductive segment 110*a* and 110*c* as well as a corresponding lower conductive segment 112*a* and 112*c*. These segments 110*a*, 110*c*, 112*a*, and 112*c* are also disposed on the dielectric substrate 108. The lower conductive segments 112*a* and 112*c* are in general grounded at their upper ends. In this manner, the upper conductive segments are effectively monopoles, so they do not need baluns to balance their feeding or loading. Also, in general, the upper segments 110*a* and 110*c* and the lower 112*a* and 112*c* are of approximately equal length.

When the upper conductive segment of one of the passive elements 104, for example, the upper conductive segment 110*a*, is connected to the respective lower conductive segment 112*a*, the passive element 104*a* operates in a reflective mode. This results in Radio Frequency (RF) energy being reflected back from the passive element 104*a* towards its source.

When the upper conductive segment 110*a* is open (i.e., not connected to the lower conductive segment 112*a* or other ground potential) the passive element 104*a* operates in a directive mode in which the passive element 104*a* essentially is invisible to the propagating RF energy which passes therethrough.

In one embodiment, the center element 102 and the passive elements 104*a* and 104*c* are fabricated from a single dielectric substrate such a printed circuit board with the respective elements disposed thereon as shown in FIG. 3A. The antenna elements can also be disposed on a deformable or flexible substrate or attached to one surface of the center element 102 as well.

A microelectronics module 122, including respective switch modules 116*a* and 116*c* may also be disposed on the same substrate 108 with conductive traces 124 being provided therebetween. The signals carried on the conductive traces 124 control the state of the components within the microelectronic modules 116*a* and 116*c* that achieve particular operating states for the passive elements 104*a* and 104*c*, e.g., to place them in either the reflective or directive state as described above. Further connected to the microelectronics module 122 is an interface 125 for providing electrical signal control connectivity between the array 120 and an external controller device such as located in the remainder of the handset 100. Interface 125 can be constructed from either a rigid or flexible material such as ribbon cable or other connector, for example.

Figure 3C:
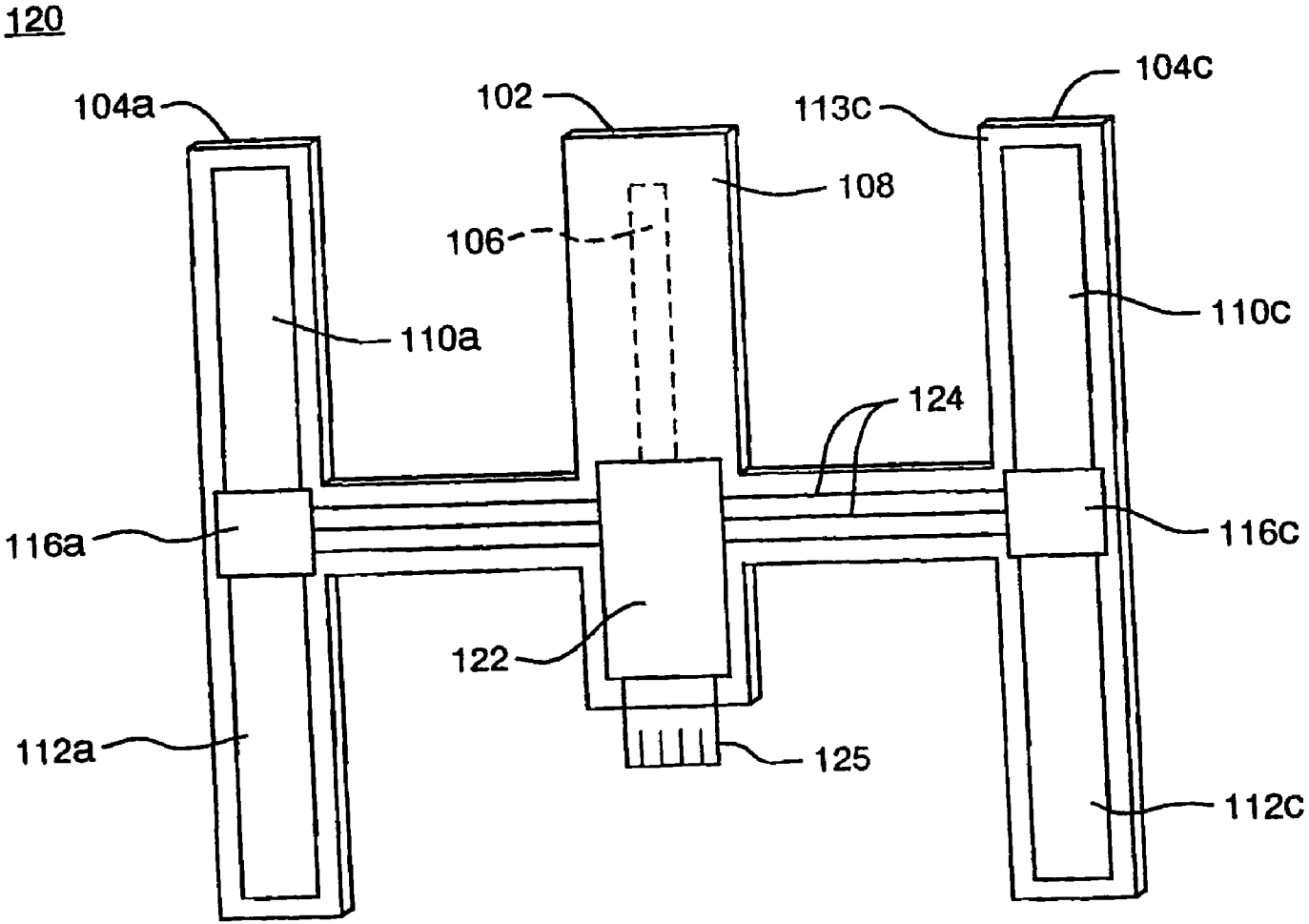
FIG. 3C is a more detailed plan of a three-element adaptive antenna array according to a further alternative embodiment.
Figure 3B:
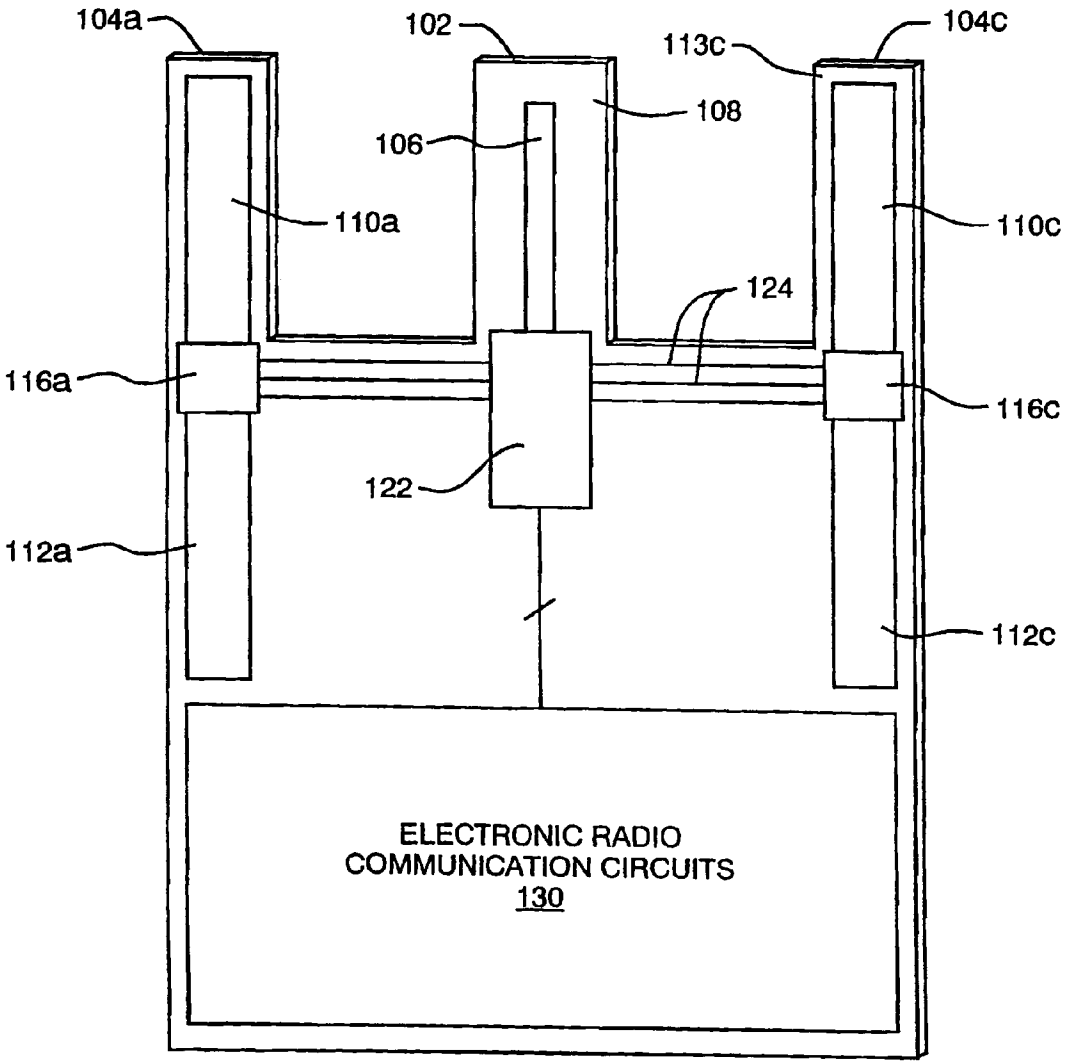
FIG. 3B is a more detailed plan of a three-element adaptive antenna array according to an alternate embodiment.

FIG. 3B is a more detailed view of a three-element adaptive antenna array according to an alternate embodiment. The center element 102 and passive elements 104*a* and 104*c* are fabricated on the same dielectric substrate as the electronic radio communication circuits 130 of the control module 410. This particular embodiment avoids the need for connectors. Manufacturing costs are reduced in part because a single printed board can be fabricated with the antenna and radio communication circuitry. Further reductions are found in line loss due in part to the elimination of connectors between the antenna and radio communication circuitry.

FIG. 3C is a more detailed view of a three-element adaptive antenna array according to a further alternative embodiment. In this embodiment, the active center element 102 (shown as the dashed rectangle) is located on an opposite face of the dielectric substrate than the passive antenna elements 104*a* and 104*c*. With this nonlinear arraying configuration, the reception and transmission of radio communication signals may be directed with more angular variations than the linear antenna configurations of FIGS. 3A and 3B.

Figure 4:
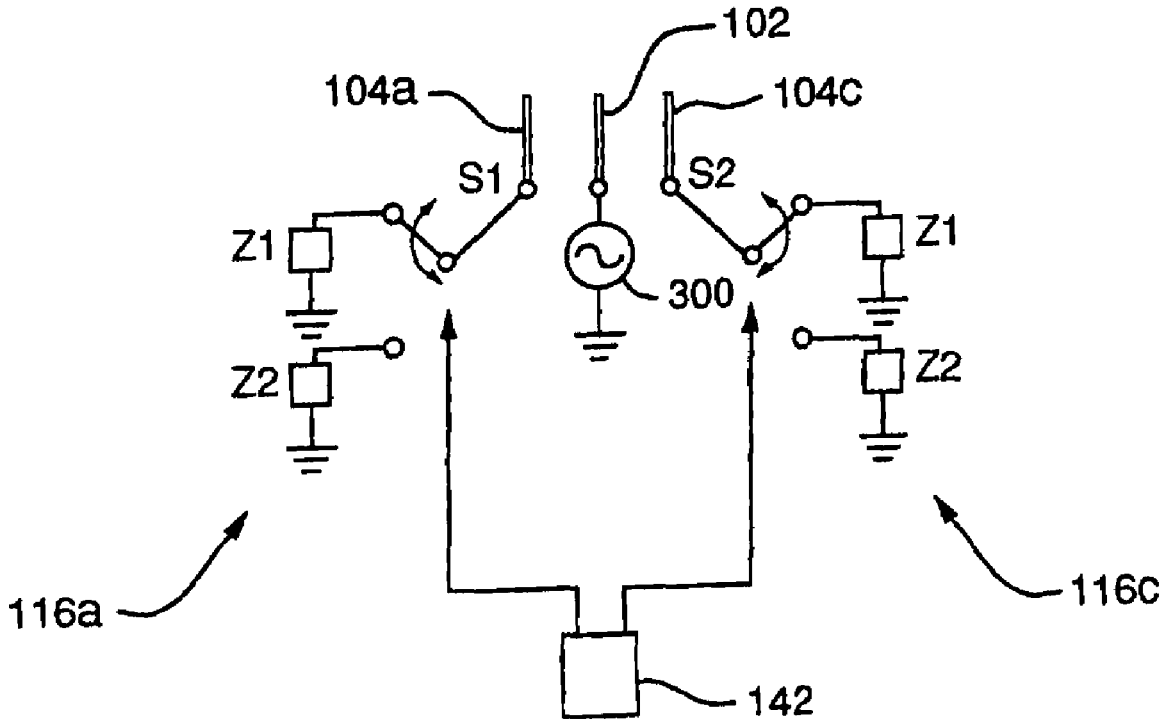
FIG. 4 is a circuit diagram showing a possible feed structure for a three-element adaptive array according to one embodiment.

FIG. 4 is a circuit diagram showing a feed structure for a three-element adaptive antenna array 120 according to one embodiment. A switch control and driver 142 associated with the electronics module 122 provides logic control signals to each of the respective control modules 116*a* and 116*c* associated with the respective elements 104*a* and 104*c*. For example, each such control module 116 may have associated with it a switch S1 or S2 and two impedances Z1 and Z2. The state of the switches S1 or S2 provides for connection states of either connecting the first impedance Z1 or the second impedance Z2. In a preferred embodiment, the second impedance Z2 may be 0 ohms and the first impedance Z1 may be infinite, thus providing the desired short circuit to ground or open circuit. However, it should be understood that other values of the impedances Z1 and Z2 are possible, such as various reactive values. In addition, other switch positions can be added to provide other angular directions of radiation.

Here it is also evident that the center element 102 is being directly driven to the receiver circuitry 300 associated with the handset. Thus, unlike other types of directive arrays, this particular directive array 120 has an advantage in that it is quite simple in operation, and complex combiners and the like are not necessary.

Figure 5A:
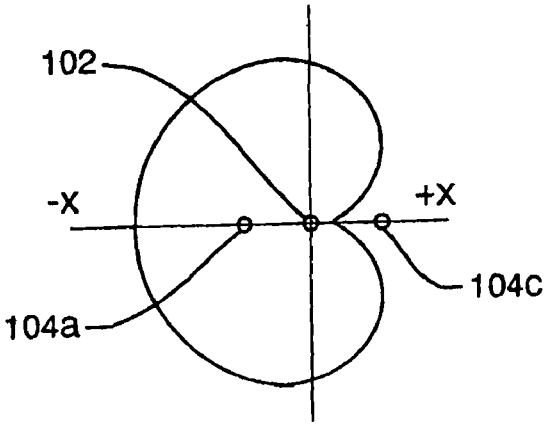
FIGS. 5A through 5D illustrate azimuthal radiation patterns for a three-element adaptive array according to the embodiments of FIGS. 3A-3C.
Figure 5B:
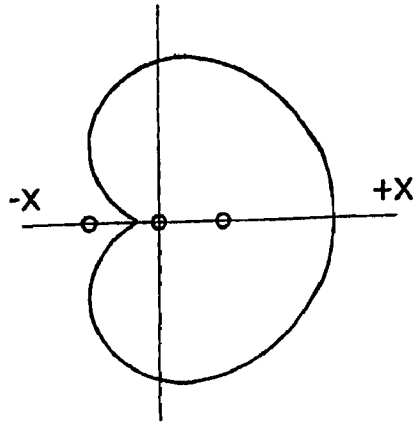

FIGS. 5A through 5D illustrate azimuthal radiation patterns available from a three-element adaptive antenna array. FIGS. 5A and 5B show radiation patterns having directive beams and deep nulls. The directive beams each covers roughly a half-circle. Each direction beam has its own deep null, which results in suppression of interfering signals to improve the signal to interference and noise ratio.

The beam pattern of FIG. 5A directed along the negative-X direction results with passive element 104*a* operating in directive mode and passive element 104*c* operating in reflective mode. Conversely, the radiation pattern of FIG. 5B directed along the +X direction results by swapping the operating modes for passive elements 104*a* and 104*c*.

Figure 5C:
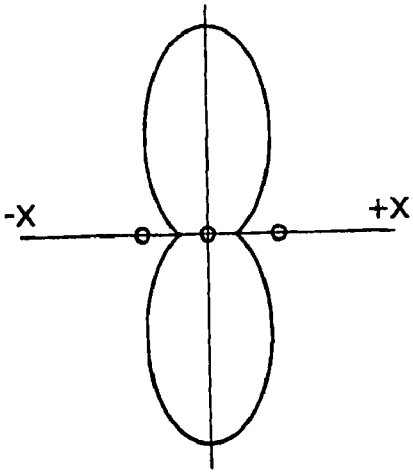
Figure 5D:
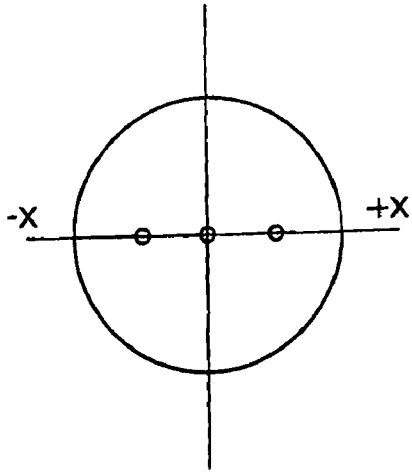

FIG. 5C shows a bi-directional radiation pattern. The bidirectional pattern can be used to add to the angular diversity, which has an equally good chance of realizing a high signal to interference and noise ratio. The bi-directional radiation pattern of FIG. 5C results with passive elements 104*a* and 104*c* both operating in reflective mode. FIG. 5D shows an omnidirectional radiation pattern, which is typically needed for pilot search. This pattern results with both passive elements operating in directive mode. By fabricating the three-element antenna array, in a non-linear arrangement, as in FIG. 3C, and adjusting the impedance values of Z's, the beam patterns may be directed with more angular positions.

Figure 6A:
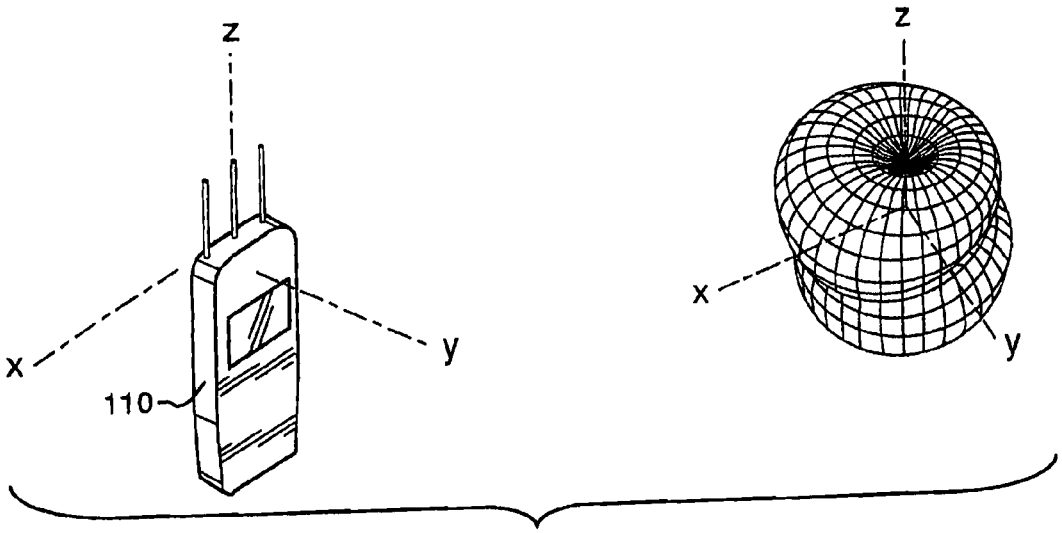
FIGS. 6A through 6C illustrate radiation patterns for a three-element adaptive array as housed in a handset.
Figure 6B:
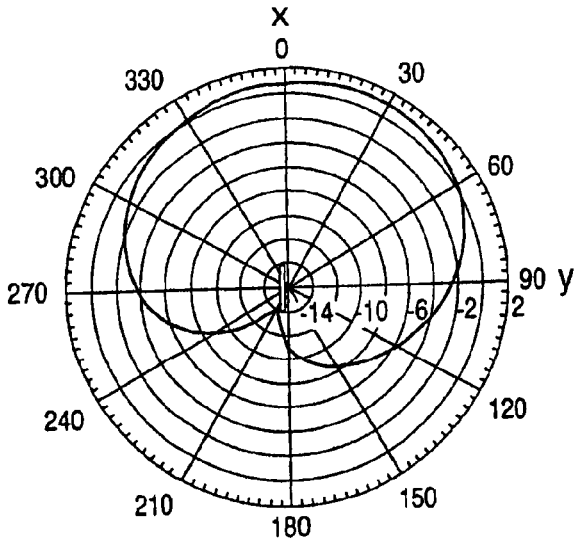

FIGS. 6A and 6B are antenna patterns illustrating performance of the array 120 as housed in a handset. The gain achievable is about 3 dBi. FIG. 6A is a three dimensional radiation pattern (in the X, Y and Z directions with respect to the referenced diagram shown for the handset 500).

FIG. 6B illustrates the azimuthal radiation pattern achievable when one of the elements is placed in directive mode and the other element is placed in reflective mode. The conducting element (which is made electrically longer in the Z direction), intercepts the received radio wave and reflects it. This creates a null in the negative X direction. Since there is no electromagnetic blockage in the +X direction, the wave passes through and creates a peak. The dimension of the circuit board in the X direction is not similar to the resonant wavelength, so that the signal is able to circulate all the way around the azimuthal plane.

Figure 6C:
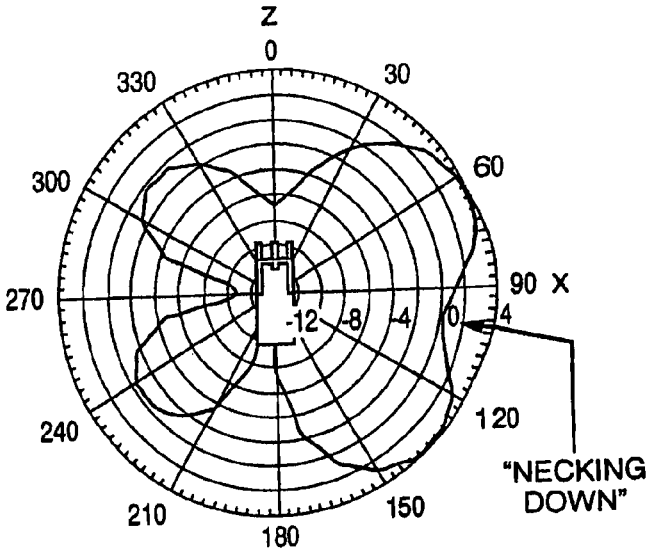

The pattern in FIG. 6C, an elevational pattern, should be compared to an ideal symmetrical pattern to illustrate the effect of the housing 110. The comparison shows that the overall effect on the azimuthal plane is a slight skewing of the beam, about 15° away from the X-axis. The pattern of FIG. 6C also illustrates "necking-down", which is an effect of placing the radiating element in a handset. Good directivity is seen, at least along an approximate 180 azimuthal plane, although skewing is evident.

FIGS. 7A through 7D are high level schematics of alternate ground structures for a three-element adaptive antenna array according to various embodiments. In wireless communication devices, such as mobile communication handsets, the body of the handset and the human hand can interfere with reception and transmission of radio communication signals. For example, the human hand can absorb RF energy reducing the gain of communication signals. In addition, the reflective effect of the human hand can shift the resonant frequency of the antennas. Also, if the near field of the antenna elements is not localized, RF current can spread to the body of the handset interfering with the performance of the device. In order to limit the interaction of the array with the body of the handset or human hand, alternate ground structures may be implemented to localize the RF current or near electromagnetic field at regions near the base of the antenna elements.

Figure 7A:
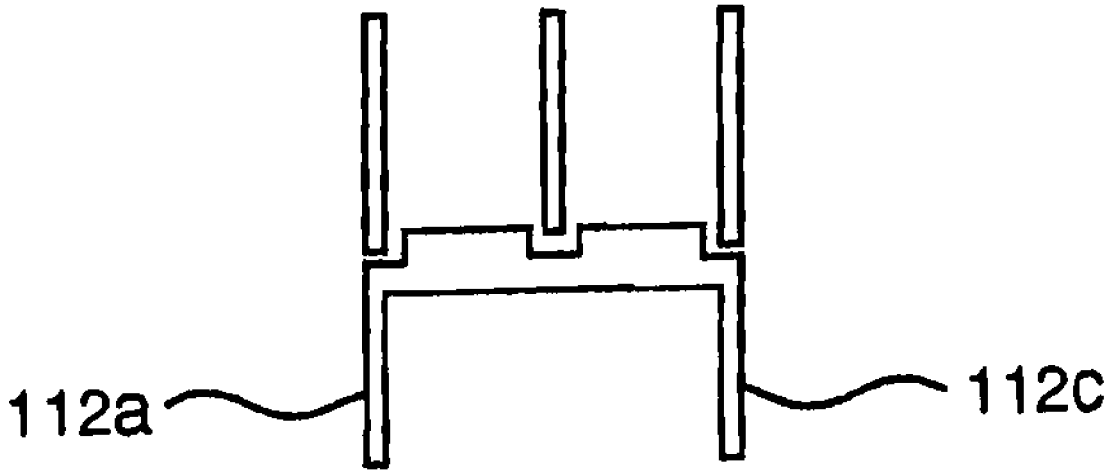
Figure 7B:
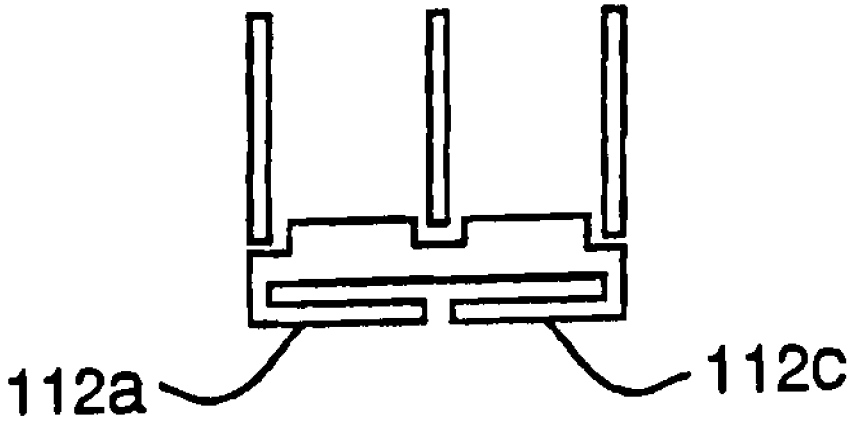

In particular, FIG. 7A illustrates a ground structure having mirror image ground strips 112*a*, 112*c*, such that the strips mirror the shape and length of the passive elements. FIG. 7B illustrates a ground structure having bent strips 112*a*, 112*c* with the same length as the passive antenna elements. FIG. 7C illustrates a ground structure shaped as a meander line 112*a*, 112*c* having an electrical length equivalent to the corresponding passive elements. FIG. 7D illustrates a ground structure as a short strip 112*a*, 112*c* which is located with inductive, dielectric or ferrite materials.

FIG. 8 is a schematic diagram of a wireless communication device 200 incorporating a two-element adaptive directional antenna array 220 according to one embodiment. In an example embodiment, the antenna array 220 consists of two monopole antenna elements 104 and 102.

Like the three-element array, the two-element array can be mounted either at the top or bottom of the handset 110 with part of the antenna and all of the ground structure hidden inside the housing. The two-element antenna array 220 may also be of relatively rigid conductors with protective coatings in thin conductor strips adhered to a film of different degrees of flexibility.

The antenna array 220 can be operated such that one element is active, while the other is passive. The designation of the active and passive elements may be fixed, but the passive elements can be made directive or reflective with different radiation phases, resulting in the antenna having multiple directive modes. The designation of active and passive elements may also be swappable, resulting in the antenna having dual directive modes. In the latter configuration, the two-element array provides the same number of directive modes with approximately a half size reduction as compared to the three element antenna array.

FIG. 9 is a more detailed view of a two-element adaptive antenna array according to one embodiment. The fabrication of the two element antenna array is similar to the three-element array of FIG. 3A, with the exception of the number of antenna elements and feed structure.

FIGS. 10A through 10C illustrate alternate circuit diagrams showing feed structures for a two-element adaptive antenna array according to various embodiments.

FIG. 10A is a circuit diagram for a feed structure where the designation of the active and passive antenna elements are fixed. A switch and control driver 242 provides logic control signals to control module 116 associated with element 104. For example, control module 116 may have associated with it a switch S1 and two impedances Z1 and Z2. The state of the switch S1 provides for connection states of either connecting the first impedance Z1 or the second impedance Z2. The achievable beam patterns achievable with this feed structure is limited to an omnidirectional or a single directive mode beam pattern. When a third switch position is added to connect to a third impedance, then a second directive pattern can be created, which can have an opposite direction and a different shape.

FIG. 10B is a circuit diagram for a feed structure in which the antenna elements are swappable between active and passive states. In this embodiment, both elements are directly coupled to the transceiver circuitry 300 associated with the handset. The switch and control driver 242 provides logic control signals to control modules 116 and 122 associated with elements 104 and 102 respectively. For example, each control module may have associated with it a switch S1 or S2 and two impedances Z1 and Z2.

In a preferred embodiment, the second impedance may be zero (0) ohms and the first impedance Z1 may be infinite, thus providing the desired short circuit to ground (SC) or open circuit (OC). The two switches S1 and S2 are then synchronized such that one of them may be connected to the open circuit and the other connects to the short circuit. The antenna element (102, or 104) that is shortened to ground is the passive element operating in reflective mode, while the antenna element (104, or 102) that is coupled to the open circuit is the active element. In this manner, the two-element array is able to provide two directive mode beam patterns and an omnidirectional beam pattern.

FIG. 10C is a circuit diagram for an alternate swappable feed structure in which another position is added to switches S1 and S2. In this embodiment, the switches S1 and S2 can individually couple the antenna elements to either ground (SC), the open circuit (OC) or to transceiver circuitry 300. With this feed structure, the active and passive states can be swapped between the two elements. Further, when an element is passive, it can operate in both reflective and directive modes.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method of receiving a communication signal in a wireless mobile handset, the method comprising:

providing a housing with a dielectric substrate located therein;

providing a passive antenna element with a base portion on a first portion of the dielectric substrate;

providing an active antenna element with a base portion on a second portion of the dielectric substrate adjacent to the passive antenna element;

the handset localizing a near field of the antenna elements toward the base portions of the antenna elements; and the handset switching between the passive antenna element and the ground structure to affect a directivity of the communication signal, wherein the communication signal is coupled to the antenna elements.

2. The method of claim 1 further comprising providing a microelectronics module between the passive element and the ground structure.

3. The method of claim 2 wherein the microelectronics module comprises a switch.

4. The method of claim 2 further comprising adjusting an operating mode of the passive element to produce a radiation pattern.

5. A method of receiving a communication signal in a wireless mobile handset, the method comprising:

providing a passive antenna element, wherein the passive antenna element is disposed on a first portion of a dielectric substrate;

providing an active antenna element, wherein the active antenna element is disposed on a second portion of the dielectric substrate; and the handset adjusting the passive antenna element in a directive mode to produce an omnidirectional radiation pattern.

6. A method of receiving a communication signal in a wireless mobile handset, the method comprising:

providing at least two passive antenna elements disposed on a first portion of a dielectric substrate;

providing an active antenna element disposed on a second portion of the dielectric substrate;

the handset operating a first of the at least two passive antenna elements in a reflective mode;

the handset operating a second of the at least two passive antenna elements in a directive mode; and the handset configuring the at least two passive antenna elements to produce an azimuthal radiation pattern.

* * * * *

UNITED STATES PATENT AND TRADEMARK OFFICE

CERTIFICATE OF CORRECTION

PATENT NO. : 7,530,180 B2
APPLICATION NO. : 11/706538
DATED : May 12, 2009
INVENTOR(S) : Chiang et al.

It is certified that error appears in the above-identified patent and that said Letters Patent is hereby corrected as shown below:

ON THE TITLE PAGE

Item (56), OTHER PUBLICATIONS, page 2, right column, on the line beginning with "Scott, et al." after the word "Adaptive" delete "Antena" and insert therefor --Antenna--.

At column 1, line 48, after the word "antenna" delete ",".

At column 2, line 8, after the word "antenna" delete "arrays" and insert therefor --array's--.

At column 2, line 45, after the word "received" delete "signals" and insert therefor --signal--.

At column 2, line 47, before the word "differential" delete "consequence" and insert therefor --consequent--.

At column 2, line 53, after the word "element" insert --signal--.

At column 2, line 55, before the words "a transmitted" delete "received" and insert therefor --receive--.

At column 2, line 67, before the words "and then" delete "received" and insert therefor --receiver--.

At column 5, line 9, before the words "high level" delete "have" and insert therefor --are--.

At column 8, line 36, before the word "azimuthal" delete "180" and insert therefor --180°--.

UNITED STATES PATENT AND TRADEMARK OFFICE

CERTIFICATE OF CORRECTION

PATENT NO. : 7,530,180 B2
APPLICATION NO. : 11/706538
DATED : May 12, 2009
INVENTOR(S) : Chiang et al.

It is certified that error appears in the above-identified patent and that said Letters Patent is hereby corrected as shown below:

At column 9, line 34, before the words "limited to" delete "is" and insert therefor --are--.

Signed and Sealed this

Sixth Day of October, 2009

David J. Kappos

David J. Kappos
*Director of the United States Patent and Trademark Office*